US005292294A

United States Patent [19]

Johnston

[11] Patent Number: 5,292,294

[45] **Date of Patent: * Mar. 8, 1994**

[54] ROTATIONAL BELT EXERCISE APPARATUS

[76] Inventor: Gary L. Johnston, P.O. Box 183, Cowarts, Ala. 36321

[ * ] Notice: The portion of the term of this patent subsequent to Sep. 26, 2006 has been disclaimed.

[21] Appl. No.: 710,541

[22] Filed: Jun. 5, 1991

[51] Int. Cl.[5] ..... A63B 21/00

[52] U.S. Cl. ..... 482/51; 601/24; 601/33; 601/35

[58] Field of Search ..... 482/57, 63, 62, 54, 482/148, 114, 37, 51, 70, 142; 128/25 R

[56] References Cited

U.S. PATENT DOCUMENTS

| | | | |
|---|---|---|---|
| 2,117,957 | 5/1938 | Heller | 482/54 |
| 3,704,886 | 12/1972 | Kay et al. | 482/63 |
| 3,966,201 | 6/1976 | Mester | 482/62 |
| 4,869,493 | 9/1989 | Johnston | 482/114 |

*Primary Examiner*—Stephen R. Crow
*Attorney, Agent, or Firm*—Richard C. Litman

[57] ABSTRACT

An exercise apparatus including a tensioned closed looped belt driven by a manually operated force-transmitting member which grips the belt between a cylinder and a support rod in one direction of movement and releases the belt in the opposite direction of movement. The exercise apparatus includes a frame unit, a belt assembly unit and user engagement members, the frame unit being collapsible into a compact unit for storage. The frame unit supports a seat with an adjustable back whereby, through the user engagement members, upper and lower body exercises may be practiced while the user remains seated. A basket may be provided for storage of user engagement members and other elements as desired.

17 Claims, 11 Drawing Sheets

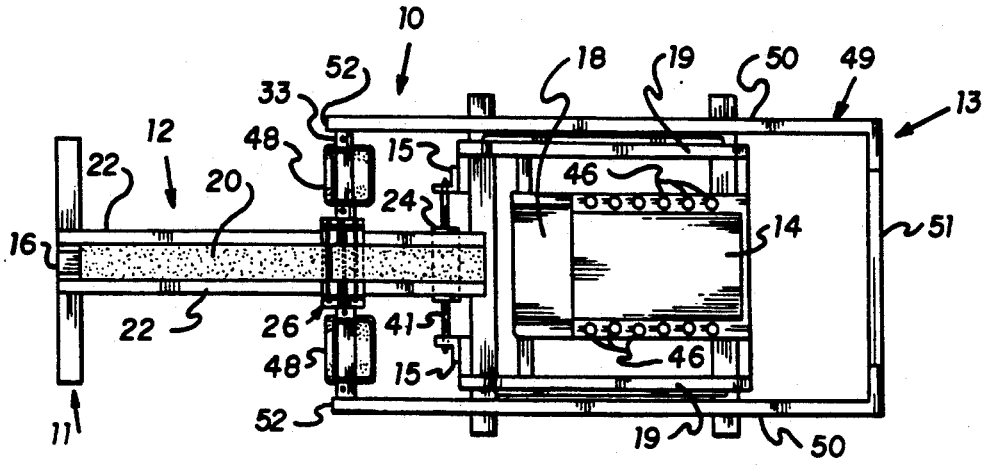
FIG. 1B
FIG. 1A
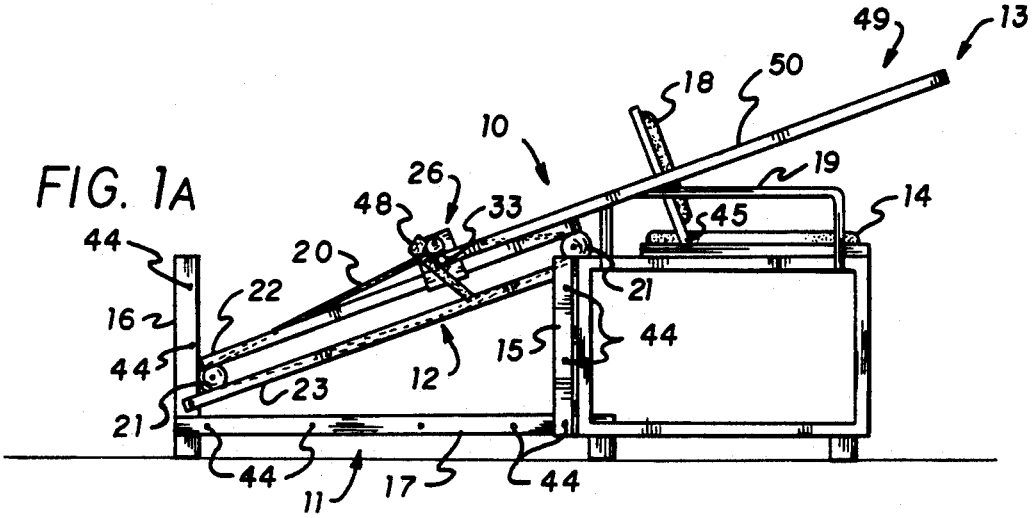
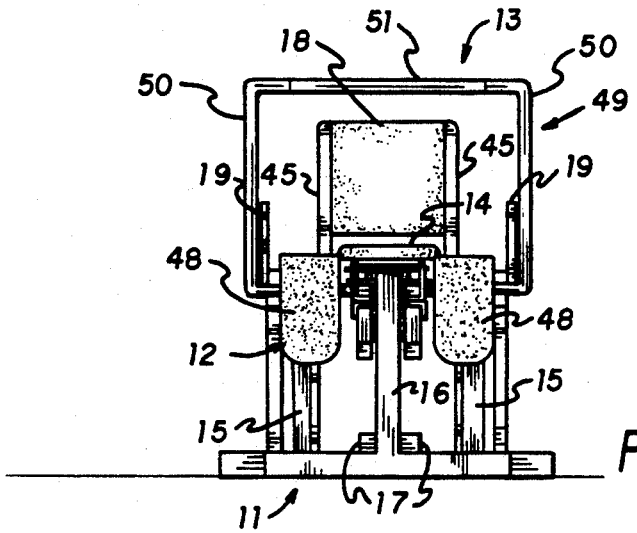
FIG. 1C

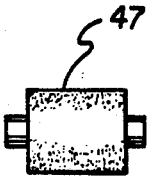
FIG. 7A
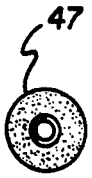
FIG. 7B
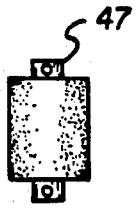
FIG. 7C
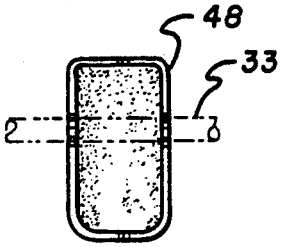
FIG. 8A
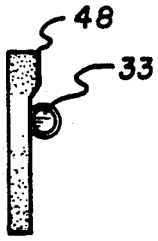
FIG. 8B
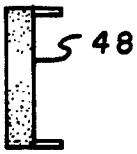
FIG. 8C
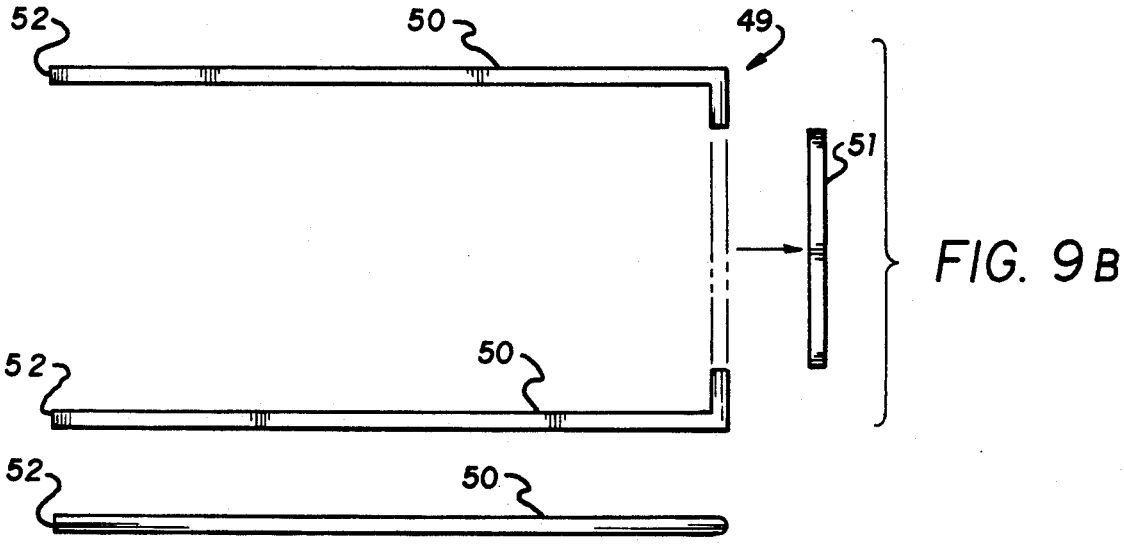
FIG. 9B
FIG. 9C
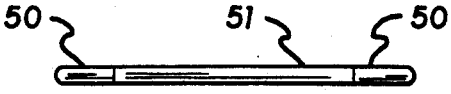
FIG. 9A
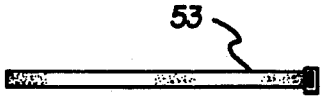
FIG. 10A
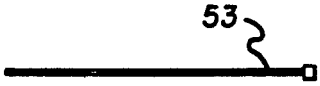
FIG. 10B
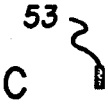
FIG. 10C

ROTATIONAL BELT EXERCISE APPARATUS

BACKGROUND OF THE INVENTION

1. Field of the Invention

This invention relates to an exercise device and in particular to an exercise apparatus which uses a rotational or rotatable belt to provide resistance against which the muscles work. The exercises are generally done from a seated position.

As can be seen from my earlier U.S. Pat. No. 4,869,493 which issued on Sep. 26, 1989, it is known to use a treadmill-type belt to provide resistance to exercise muscles while in a seated position. The treadmill-associated apparatus suffers many deficiencies, however, including being large and bulky in size and confined to a horizontal position. In addition, the treadmill-associated apparatus of my prior patent does not include structure for engaging the force-transmitting member using the lower body. Given the fact that there are vast numbers of specialized exercise apparatus, no one to date has effectively combined an upper and lower body exercise apparatus that uses a rotatable belt as the power base. The aforementioned treadmill-associated exercise apparatus does provide a belt power base, but its present design does not use this power base to its fullest potential.

2. Description of Related Prior Art

U.S. Pat. No. 1,766,089 issued to A. J. Wood on Jun. 24, 1930 discloses another treadmill exercise device wherein the exercise is conducted while standing. U.S. Pat. No. 3,704,886 issued to George Kay and Alexander Efimov on Dec. 5, 1972 discloses an exercising machine with spring return pedals and pull lines, but no engagement with a resistance belt. U.S. Pat. No. 3,759,512 issued to Amos W. Yount and Shellie D. Wells on Sep. 18, 1973 discloses an exercise machine wherein exercises may be achieved while seated, but there is no disclosure therein of a resistance belt. U.S. Pat. No. 3,966,201 issued to Joseph Mester on Jun. 29, 1976 discloses an exercising machine which incorporates a brake assembly including brake shoes which variably and selectively contact brake drums, and a belt tensioner for varying drag exerted by belts on the brake drums and on belt pulleys. U.S. Pat. No. 4,805,901 issued to John M. Kulick on Feb. 21, 1989 discloses an exercise device which is collapsible into a compact configuration for storage.

SUMMARY AND OBJECTS OF THE INVENTION

It is an object of this invention to provide an exercise apparatus which effectively combines an upper and a lower body exercise device that uses a rotatable belt as the resistance.

It is a further object of this invention to provide an exercise apparatus which is collapsible into a compact configuration for storage.

Briefly stated, the exercise apparatus that forms the basis of the present invention comprises a structural frame unit, a rotational belt assembly unit, and a user engagement assembly.

The structural frame unit includes a seat member from which the user operates the device, a first vertical support member for attaching and holding the front end of the rotational belt assembly unit, and a second vertical support member and a horizontal support member for selectively attaching and holding the back end of the rotational belt assembly unit.

The rotational belt assembly unit comprises a belt rotatable about two cylindrical elements, upper and lower guide rails cooperating with the two cylindrical elements, a traversing mechanism which traverses along the lower guide rails and attaches the front end of the rotational belt assembly unit to the first vertical support member in the structural frame unit, and a force-transmitting member which traverses along the upper guide rails and which is operatively connected to the rotatable belt. A belt tension device is part of the rotational belt assembly unit to provide a resistance of motion for the rotatable belt.

In addition, as will be explained in greater detail below, the force-transmitting member is provided with a releasable gripping means which frictionally engages the rotatable belt when the force-transmitting member is moved in one direction, and which is disengaged from the rotatable belt when the force-transmitting member is moved in the opposite direction. The releasable gripping means is also provided with a reversing mechanism whereby the direction of engagement between the force-transmitting member and the rotatable belt may be reversed. In an intermediate position of the reversing mechanism, the force-transmitting member engages the rotatable belt in both directions of movement of the force-transmitting member. Additionally, as shown in FIGS. 11, 11A and 12, a bicycle pedaling attachment may be substituted for the force-transmitting member if found to be desirable.

The user engagement assembly includes a padded cylindrical attachment, a footrest attachment, a handle attachment, and a strap attachment, the attachments providing for upper and lower body connection with the force-transmitting member. These elements may be connected to and disconnected from the force-transmitting member as needed.

The exercise apparatus is designed to be collapsible into a compact unit for storage.

Other objects, features and advantages for this invention will be apparent from the following detailed description and the appended claims, reference being had to the accompanying drawings forming a part of the specification, wherein like reference numerals designate corresponding parts of the several views.

BRIEF DESCRIPTION OF THE DRAWINGS

FIG. 1A is a side view of the rotational belt exercise apparatus in a typical upper body workout position.

FIG. 1B is a top view of the exercise apparatus for a typical upper body workout.

FIG. 1C is a rear view of the exercise apparatus for a typical upper body workout, looking from the left side of FIG. 1A.

FIG. 7A is a front view of a padded cylindrical attachment for user engagement with the rotational belt exercise apparatus.

FIG. 7B is an end view of the padded cylindrical attachment.

FIG. 7C is a top view of the padded cylindrical attachment.

FIG. 8A is a front view of a footrest attachment for user engagement with the rotational belt exercise apparatus.

FIG. 8B is a side view of the footrest attachment.

FIG. 8C is a top view of the footrest attachment.

FIG. 9A is a front view of a handle attachment for user engagement with the rotational belt exercise apparatus.

FIG. 9B is a top view of the handle attachment.

FIG. 9C is a side view of the handle attachment.

FIG. 10A is a front view of an attachment belt for user engagement with the rotational belt exercise apparatus.

FIG. 10B is a top view of the attachment belt.

FIG. 10C is an end view of the attachment belt.

DETAILED DESCRIPTION OF THE PREFERRED EMBODIMENT

Figure 2B:
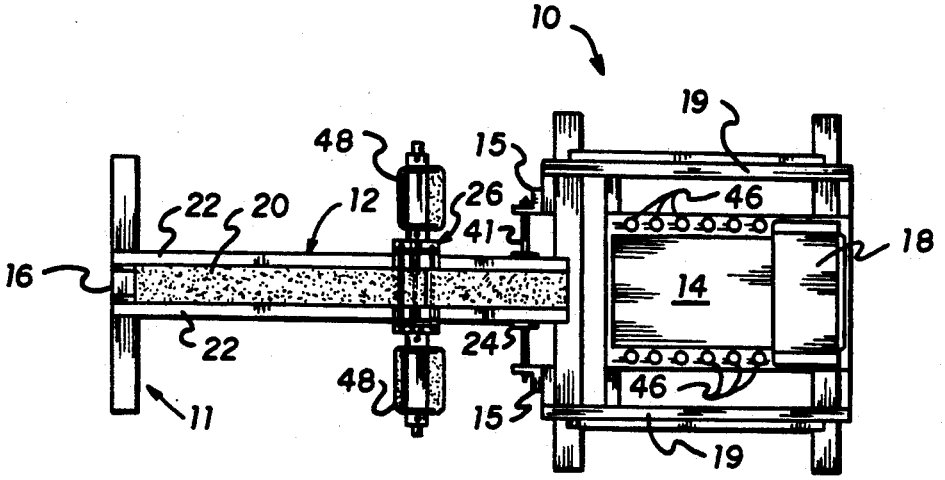
FIG. 2B is a top view of the exercise device in a typical lower body workout position.
Figure 2A:
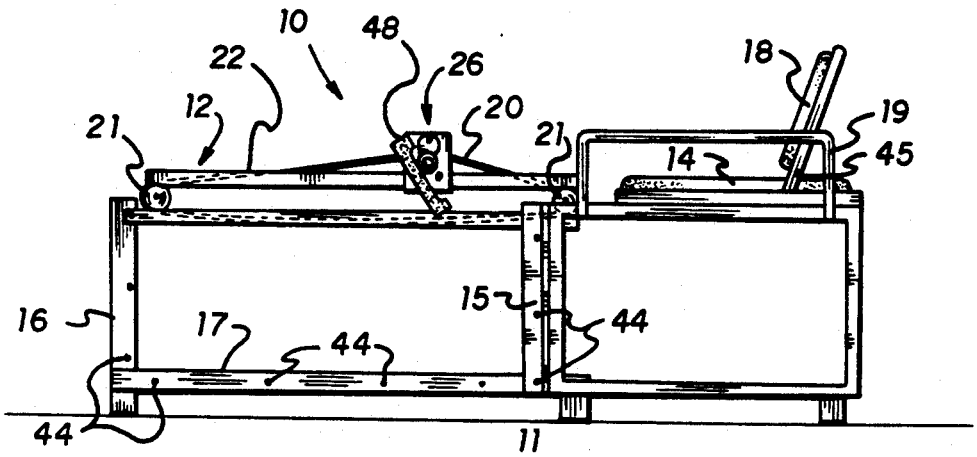
FIG. 2A is a side view of the exercise device in a typical lower body workout position.
Figure 2C:
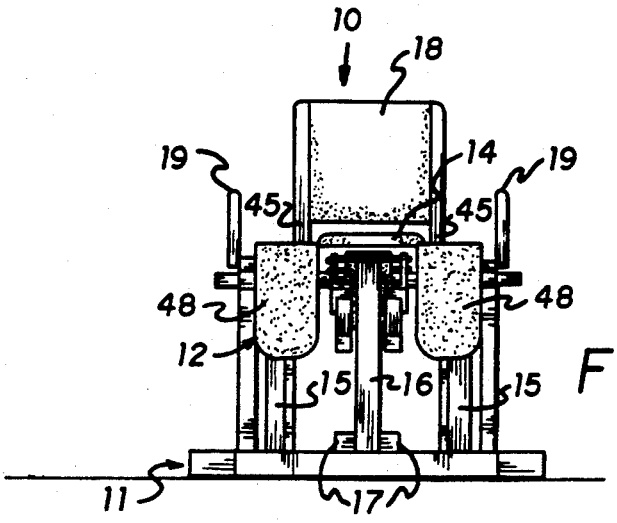
FIG. 2C is a rear view of the exercise device in a typical lower body workout position, looking from the left side of FIG. 2A.

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of description, and not limitation.

As can best be seen by reference to the drawings, and in particular to FIGS. 1A-2C, the exercise apparatus that forms the basis of the present invention is designated generally by reference numeral 10. Exercise apparatus 10 comprises a structural frame unit 11, a rotational belt assembly unit 12, and a user engagement assembly 13 which includes a variety of attachments described below.

Figure 3B:
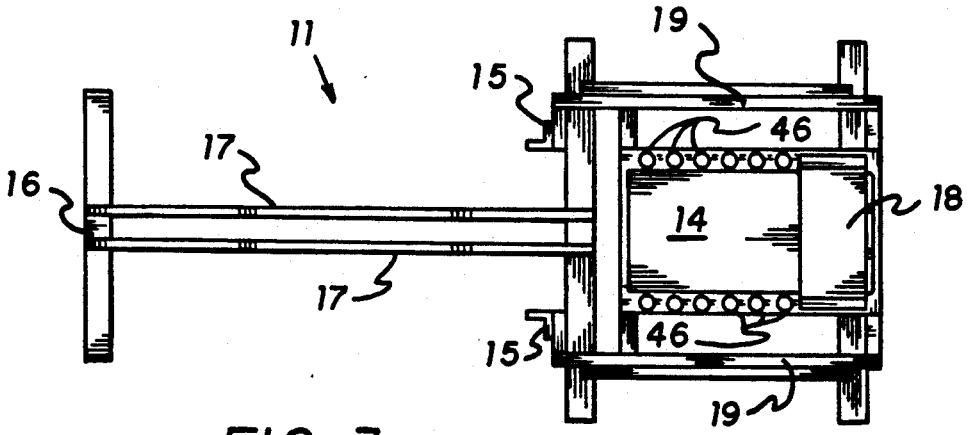
FIG. 3B is a top view of the structural frame unit.
Figure 3A:
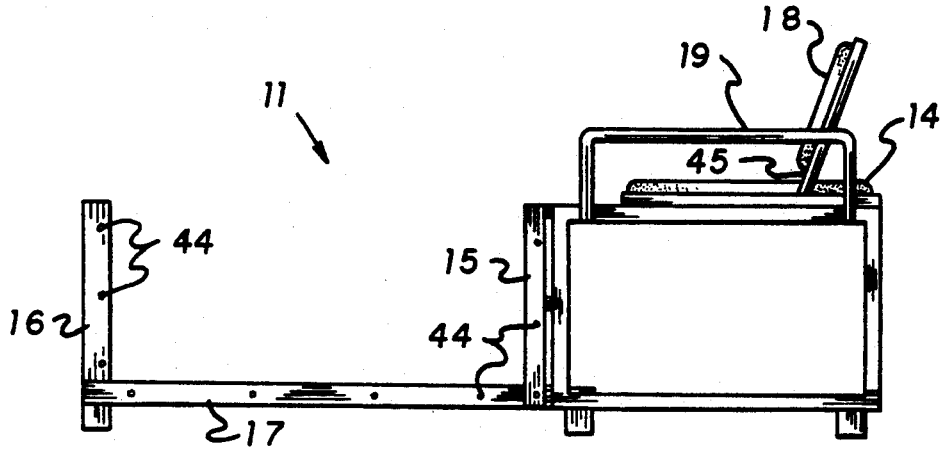
FIG. 3A is a side view of the structural frame unit.
Figure 3C:
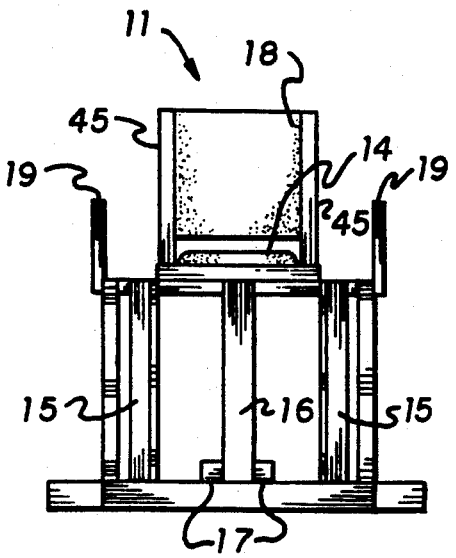
FIG. 3C is a rear view of the structural frame unit, looking from the left side of FIG. 3A.

As shown in FIGS. 3A-3C, the structural frame unit 11 of the rotational belt exercise apparatus 10 comprises a seat support member 14 from which the user operates the device, a vertical support member 15 for attaching structural frame unit 11 to the front end of rotational belt assembly unit 12, a vertical support member 16 and horizontal support member 17 for selectively attaching the rear end of rotational belt assembly unit 12 to structural frame unit 11, and a seat back support member 18 and hand rail support members 19 for providing support to the user.

Figure 4B:
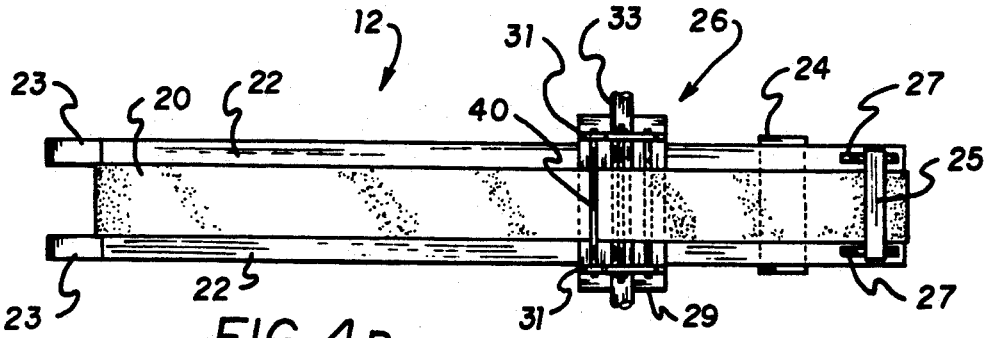
FIG. 4B is a top view of the rotational belt assembly unit.
Figure 4A:
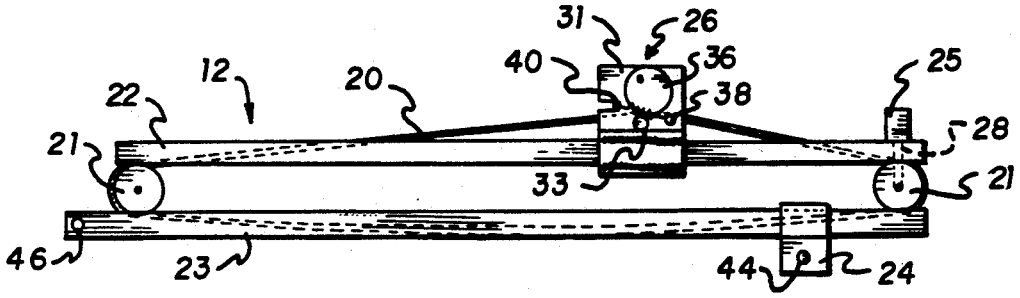
FIG. 4A is a side view of the rotational belt assembly unit.
Figure 4C:
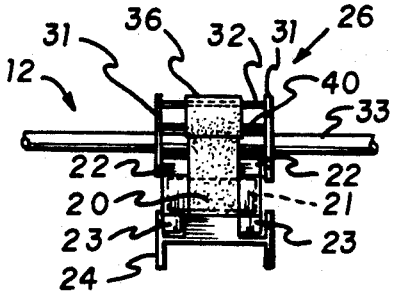
FIG. 4C is a front view of the rotational belt assembly unit looking from the left side of FIG. 4A.
Figure 5B:
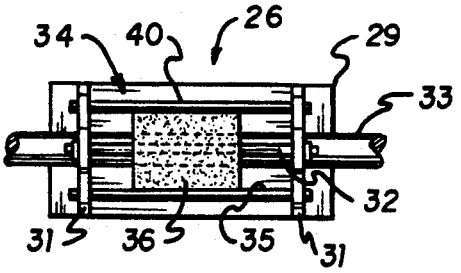
FIG. 5B is a top view of the releasable gripping means of the apparatus.

Referring to FIGS. 4A-4C, rotational belt assembly unit 12 comprises a closed loop belt 20 supported for movement about cylindrical rollers or pulleys 21 suitably mounted for rotation in said rotational belt assembly unit 12, upper and lower guide rails 22 and 23, a traversing mechanism 24 shiftable along the lower guide rails 23 and connectable to vertical support member 15 of structural frame unit 11, a belt tension adjustment device 25 which provides a resistance to belt motion, and a force-transmitting member 26 which traverses along the upper guide rails 22 and operatively engages belt 20. The rotational belt assembly unit 12 pivots about structural frame unit 11 at the point of attachment of traversing mechanism 24. Belt tension device 25 exerts a force upon belt 20 against one of the cylindrical rollers or pulleys 21. The size of this force may be varied, which causes the resistance to belt motion to vary, by shifting belt tension adjustment device 25 along slots 27 in upper guide rails 22 and then locking belt tension adjustment device 25 in position by any suitable means. Belt tension adjustment device 25 is operatively connected to front cylindrical roller 21 in a conventional manner as by rods 28.

Figure 4D:
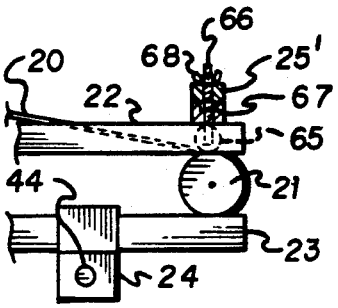
FIG. 4D is a side view of the rotational belt assembly unit with a modified belt tension device.

A modified belt tension device 25' is shown in FIG. 4D, comprising a pressure roller 65 which presses belt 20 against cylindrical roller or pulley 21 under the control of conventional adjustment means such as a screw 66 and locking nuts 67 and 68. The tighter belt 20 is pushed against cylindrical roller or pulley 21, the harder it will be for belt 20 to be moved. This provides a means for adjusting the amount of force needed by the user to move the belt 20.

As shown in FIGS. 5A-5E, the frame 29 of the force-transmitting member 26 is provided with open channels 30 adapted to receive the upper guide rails 22 and upward standing sides 31 which support the upper axle member 32, the lower support rod element 33, and the contact rod assembly 34. Force-transmitting member 26 is also provided with a releasable gripping means 35 comprising a press cylinder member 36 operatively and rotatably secured in an axially offset fashion relative to upper axle member 32. Press cylinder member 36 is provided with a high friction coating 37 such as rubber or the like to enhance the frictional engagement between press cylinder member 36 and belt 20, as will be explained presently. Force-transmitting member 26 also includes a second support rod element 38 whose purpose is explained below.

Upper axle member 32 and press cylinder member 36 are adapted to contact the upper surface of belt 20 while lower support rod element 33 is adapted to lift and support the underside of belt 20.

Given the axially offset relationship of the press cylinder member 36 relative to the upper axle member 32, it can be appreciated that when press cylinder member 36 is located on the right hand side of the lower support rod element 33, movement of the force-transmitting member 26 to the right will cause press cylinder member 36 to pinch belt 20 against lower support rod element 33 to offer resistance to the user. On the other hand, movement of the force-transmitting member 26 to the left will disengage the press cylinder member 36 from tight frictional engagement with the belt 20 and offer very minimal resistance to the user.

It is necessary for press cylinder member 36 to always remain in some type of contact with belt 20 due to the effect of gravity forces on press cylinder member 36 when the rotational belt assembly unit is in a vertical position. Therefore, a contact rod assembly 34 is provided on the rear lower side of press cylinder member 36. Contact rod assembly 34 contains a spring element 39 which pulls a contact rod 40 toward press cylinder member 36. Contact rod 40 will provide light contact between press cylinder member 36 and belt 20, thereby prohibiting the loss of belt contact.

When the user wishes to reverse the direction of force resistance provided by releasable gripping means 35, all that is required is the rotation of the press cylinder member 36 counterclockwise about the upper axle member 32 such that the press cylinder member 36 is located on the left side of lower support rod element 33. Once this is accomplished, press cylinder member 36 will pinch belt 20 when force-transmitting member 26 is moved to the left, and press cylinder member 36 will release the belt 20 when the force-transmitting member is moved to the right.

Figure 5A:
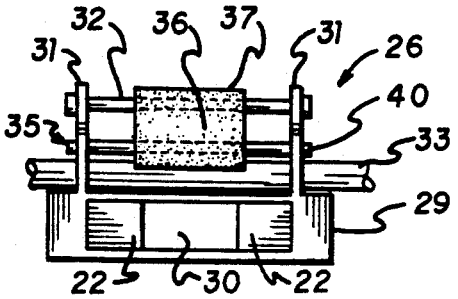
FIG. 5A is a front view of the releasable gripping means of the apparatus.
Figure 5C:
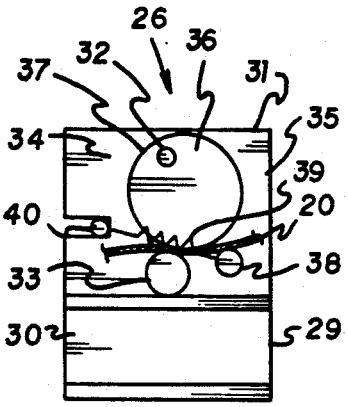
FIG. 5C is an enlarged side view of the releasable gripping means in one mode of operation.
Figure 5D:
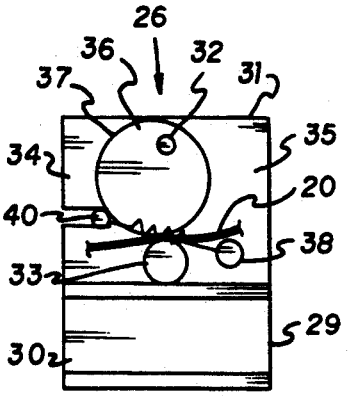
FIG. 5D is an enlarged side view of the releasable gripping means in a second mode of operation.
Figure 5E:
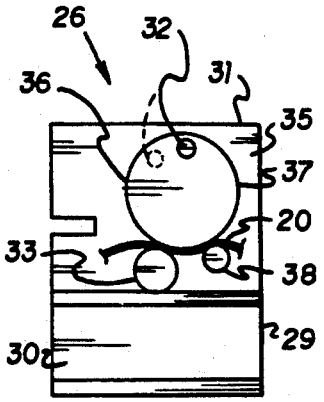
FIG. 5E is an enlarged side view of the releasable gripping means in a third mode of operation.

Also, it is possible to shift upper axle member 32 to the right as shown in FIG. 5E by mounting upper axle member 32 in another pair of holes in upward standing sides 31. This alteration will then cause the press cylinder member 36 to remain in tight contact with belt 20 when force-transmitting member 26 is moved in either the right or left direction.

Figure 6A:
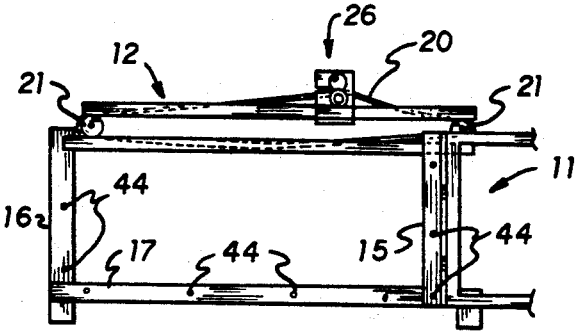
FIG. 6A is a side view of the structural frame unit and the connected rotational belt assembly unit in one typical operating position.
Figure 6B:
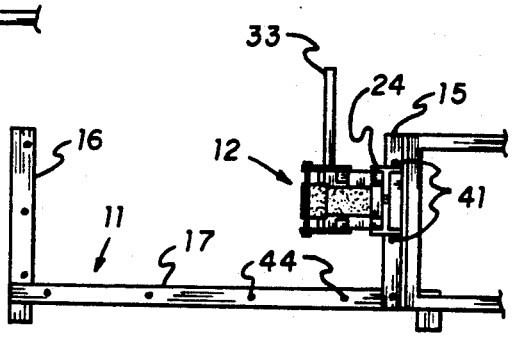
FIG. 6B is a side view of the structural frame unit and the connected rotational belt assembly unit a second typical operating position.
Figure 6C:
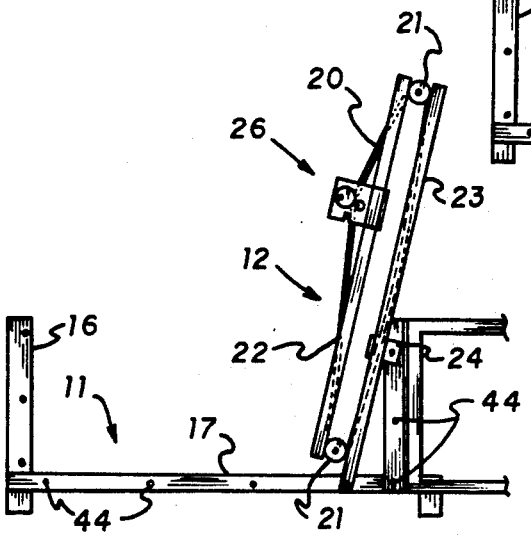
FIG. 6C is a side view of the structural frame unit and the connected rotational belt assembly unit in a third typical operating position.

As can be seen in FIGS. 6A-6C, rotational belt assembly unit 12 can be supported by structural frame unit 11 in many positions, by inserting a suitable rod similar to rod 41 through opening 44 in traversing mechanism 24 and opening 46 in lower guide rails 23, the rods also passing through selected ones of a plurality of openings 44 in structural frame unit 11. In FIG. 6B, traversing mechanism 24 can be friction-fit between two rods 41, with lower support rod 33 pushed upward to avoid interference with horizontal support member 17. In FIG. 6A, rotational belt assembly unit 12 is supported horizontally on structural frame unit 11, while in FIG. 6C, rotational belt assembly unit 12 is supported substantially vertically by structural frame unit 11. These various positions are applicable to both upper and lower body workout. The ability to angle the force generated by the rotatable belt 20 greatly enhances the exercising features.

As mentioned above, structural frame unit 11 includes a seat back support member 18, a seat support member 14, and hand rail support members 19. The seat back support member 18 may be positioned facing in either the forward (FIG. 2A) or backward (FIG. 1A) direction at various locations along seat support member 14 which remains stationary, by inserting side bars 45 into openings 46 located along seat support member 14. Such positioning allows for performing both upper and lower body workouts and compensates for differences in the size of various users. Hand rail support members 19 provide the user with a means of personal support while operating the rotational belt exercise apparatus 10.

FIGS. 7A-12 disclose a variety of attachments which collectively make up user engagement assembly 13. In FIGS. 7A-7C, there is shown a representative padded cylindrical attachment 47 which may be mounted on force-transmitting member 26 in place of the footrest attachment 48 shown in FIGS. 1A, 1B, 1C, 2A, 2B, 2C, 8A, 8B and 8C. In FIGS. 9A-9C, there is shown a handle 49 which may be attached to the ends of lower support rod element 33 as shown in FIGS. 1A and 1B to enable manual movement of force-transmitting member 26. Handle 49 is, in general, a U-shaped tubular element composed of two generally L-shaped elements 50 and a single straight intermediate segment 51 which may be removed as desired. The ends 52 of the handle are connected to either the padded cylindrical attachment 47 or the footrest attachment 48, whichever is presently attached to lower support rod element 33. In FIGS. 10A-10C, there is shown an attachment strap 53 necessary to secure the user to the other above-identified attachments.

As seen, the attachments 47,48,49 that comprise the upper and lower body engagement assembly 13 attach to the force-transmitting member 26 by sliding over the portions of the lower support rod element 33 which extends from the frame 29 of force-transmitting member 26. The padded cylindrical attachment 47, the footrest attachment 48, and the attachment strap 53 are located on the lower support rod element 33 and are used mainly for lower body workout. Their relative positions along the lower support rod element 33 may be altered by switching sides. Handle 49 is used mainly for upper body workout.

Figure 11:
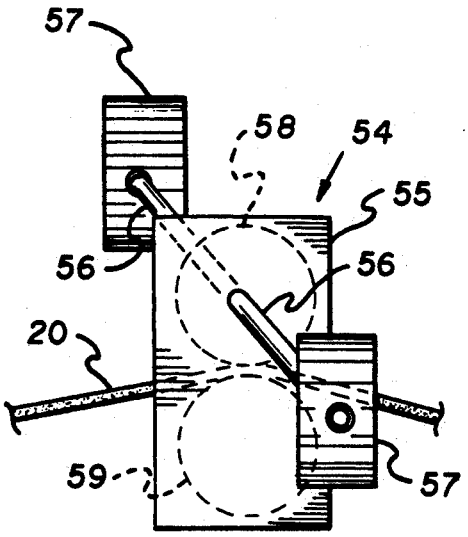
FIG. 11 is a side view of a bicycle pedaling attachment for user engagement with the rotational belt exercise apparatus.
Figure 12:
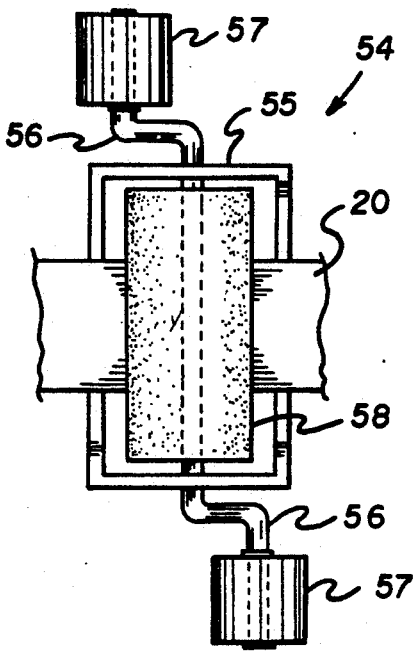
FIG. 12 is a top view of the bicycle pedaling attachment.
Figure 11A:
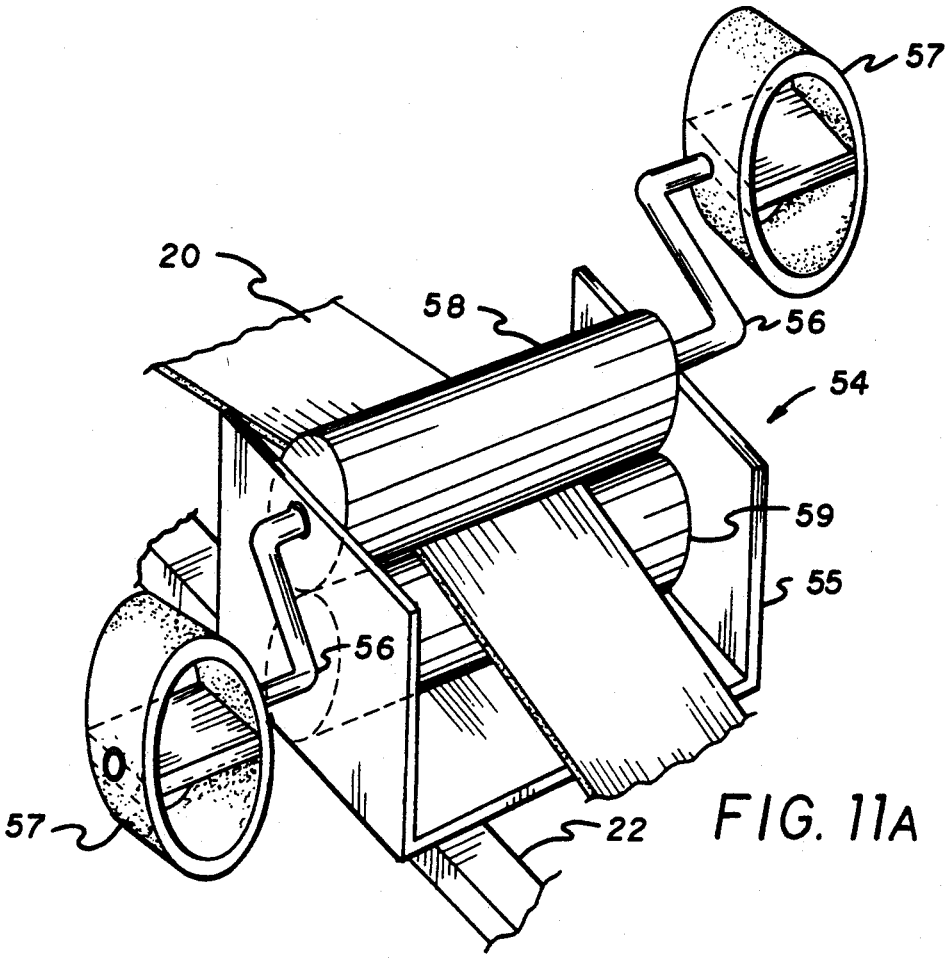
FIG. 11A is a perspective view of the bicycle pedaling attachment.

FIGS. 11, 11A and 12 depict a modification of force-transmitting member 26, identified by reference numeral 54. Force-transmitting member 54 is substituted for force-transmitting member 26 in rotational belt exercise apparatus 10, and is specifically designed to enable the user to engage in bicycle pedaling exercises. Force-transmitting member 54 comprises a frame 55 suitably attachable to upper guide rails 22 as a substitute for force-transmitting member 26, a rotatable shaft 56 supported by frame 55, said shaft being configured as a crank to enable a pedaling operation, footrests or pedals 57 suitably mounted on the ends of the shaft or crank 56, a drive roller 58 mounted on said shaft or crank 56 for rotation with said shaft or crank 56, and a pinch roller 59 suitably mounted on frame 55 to cooperate with belt 20 and drive roller 58, whereby during pedal operation belt 20 is driven against the resistance offered by belt tension adjustment device 25 (FIGS. 4A and 4B).

By now it should be appreciated that in the preferred mode of deployment of rotational belt exercise apparatus 10 the user places seat back support member 18 in the forward-facing direction depicted in FIGS. 1A–1C for normal upper body workout. The user places the seat back support member 18 in the backward-facing direction depicted in FIGS. 2A–2C for normal lower body workouts. Many exercises may be developed for the upper body as well as the lower body which would utilize seat back support member 18 in various positions.

Figure 13:
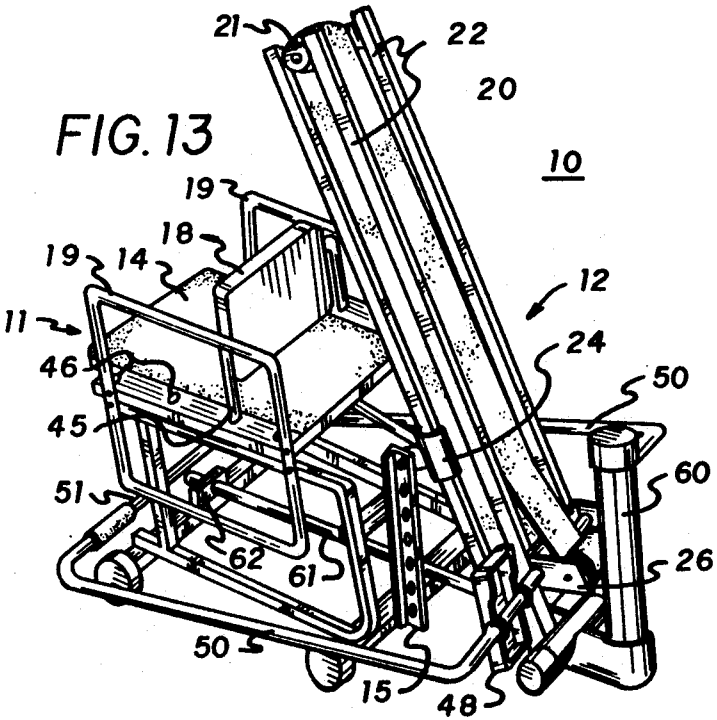
FIG. 13 is a perspective view showing the rotational belt exercise apparatus partially collapsed for compact storage with a modified structural frame unit.
Figure 14:
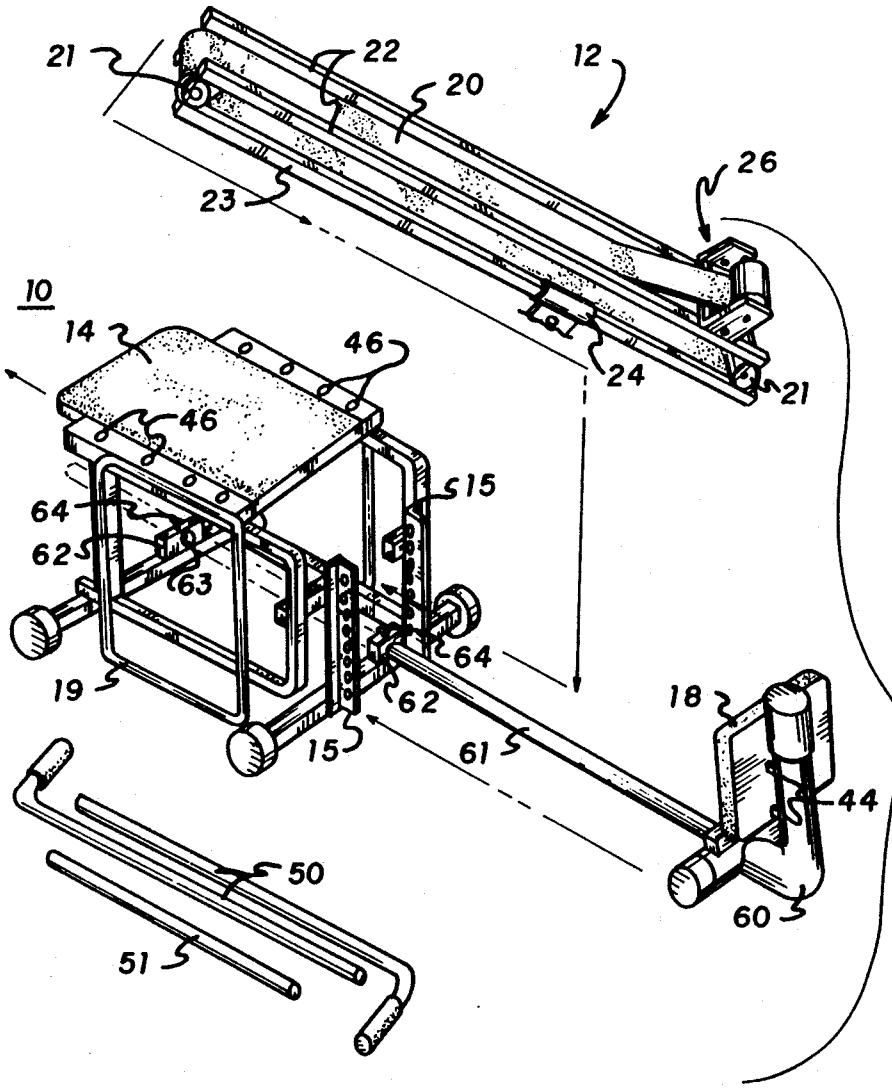
FIG. 14 is a perspective exploded view showing the collapsed state of the exercise apparatus with the modified structural frame unit of FIG. 13.

FIGS. 13 and 14 show a modification of structural frame unit 11 and the manner in which the rotational belt exercise unit 10 may be collapsed into a compact area for storage purposes. In structural frame unit 11 as modified, vertical support member 16 and horizontal support member 17 are replaced by cylindrical elements 60 and 61, respectively. Horizontal support member 61 is attached to the main portion of frame 11 by means of blocks 62 having openings 63 therein to receive horizontal support member 61, the horizontal support members being held in position in blocks 62 by means of set screws 64. By loosening set screw 64 in FIG. 14, horizontal support member 61 may be shifted to underlie seat support member 14 as in FIG. 13, whereby the rotational belt exercise apparatus 10 may be collapsed to a more compact configuration. In doing so, rotational belt assembly unit 12 may be left in the substantially vertical position as shown in FIG. 13, or also stored beneath seat support member 14 as suggested in FIG. 14. In similar fashion, in the embodiment of FIGS. 1A–1C, the bolts or rods holding horizontal support member 17 in position in relation to the main portion of structural frame unit 11 may also be removed, allowing horizontal support member 17 to be shifted under seat support member 14 whereby rotational belt exercise apparatus 10 may be collapsed to a more compact configuration for storage purposes. As shown in FIG. 14, seat back support member 18 may be removed from openings 46 and stored on vertical support member 60, or in the case of the embodiment of FIGS. 1A, 1B, and 1C, on vertical support member 16. It should also be noted that hand rail support member 19 may also be lowered upon the removal of bolts or rods from openings 44.

Figure 15:
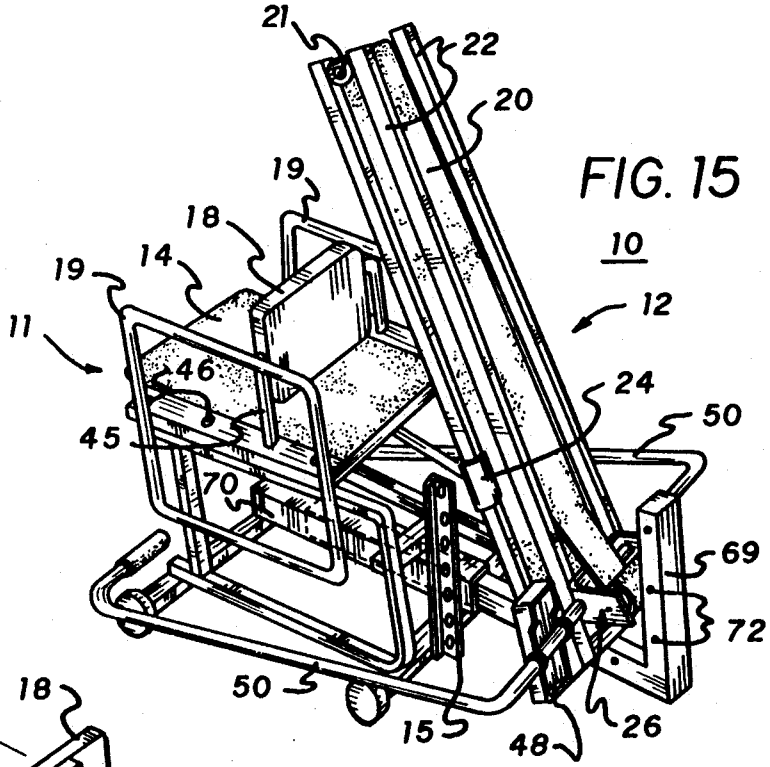
FIG. 15 is a perspective view of a second modification of the structural frame unit showing the rotational belt assembly unit in a partially collapsed position for storage purposes.
Figure 16:
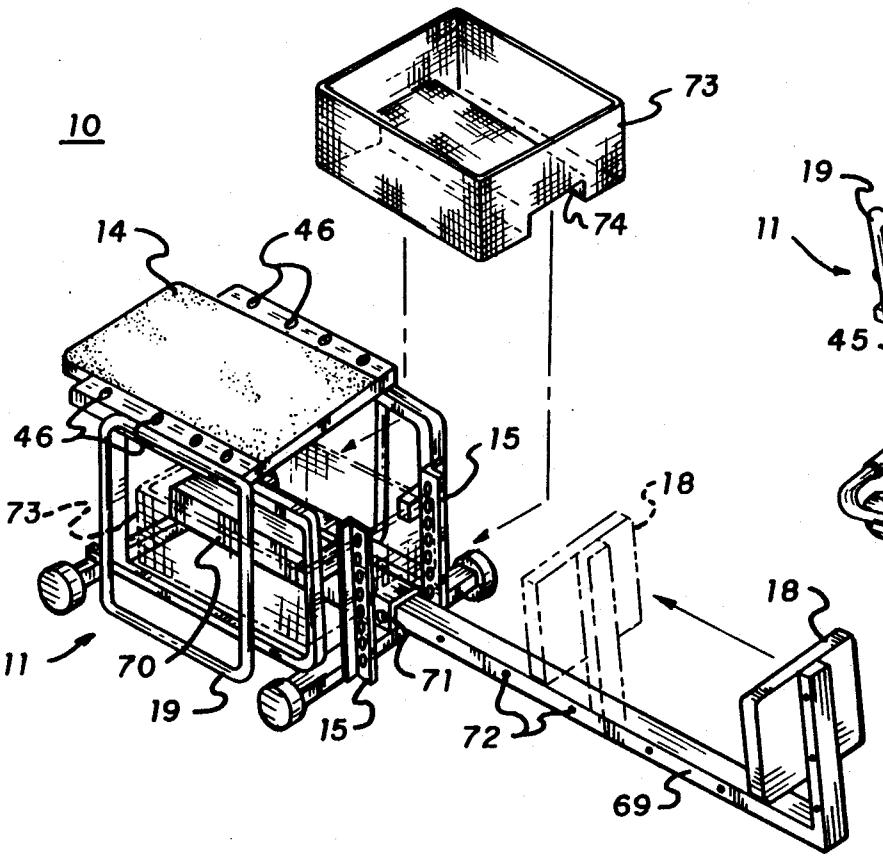
FIG. 16 is a perspective view of the second modification of the structural frame unit together with a basket for storage of accessories.

In FIGS. 15 and 16, a second modification of structural frame unit 11 is shown. In this modification, vertical support member 16 and horizontal support member 17 are replaced by a solid L-shaped member 69 having a rectangular cross-section and adjustably held in position by means of a sleeve 70, bolts 71 and bolt holes 72.

Also shown in FIG. 16 is a basket 73 configured as at 74 to fit over sleeve 70, basket 73 serving as a convenient storage area for accessories and the like. With basket 73 in position, rotational belt assembly unit 12 would be stored under seat support member 14 above basket 73, as shown for example in FIG. 21. In the alternative, two separate baskets (not shown) configured to fit on either side of sleeve 70 may be substituted for basket 73.

Figure 17:
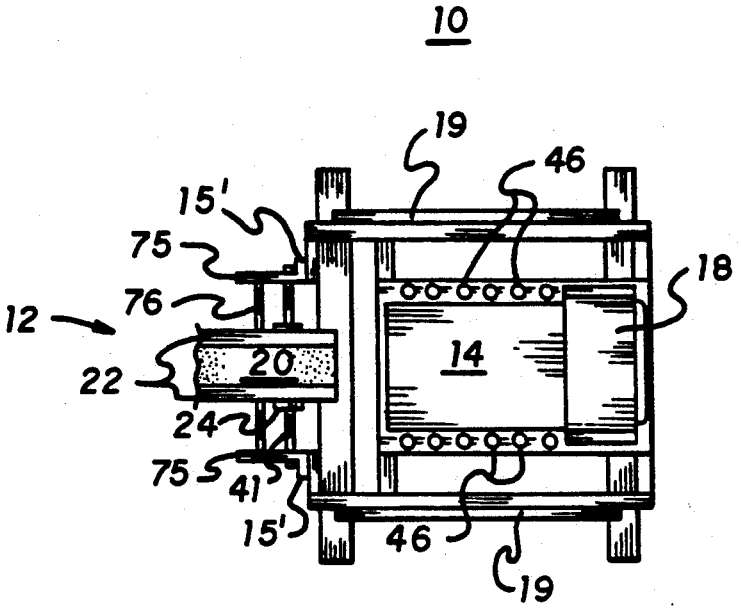
FIG. 17 is a top view of a third modification of the structural frame unit.
Figure 18:
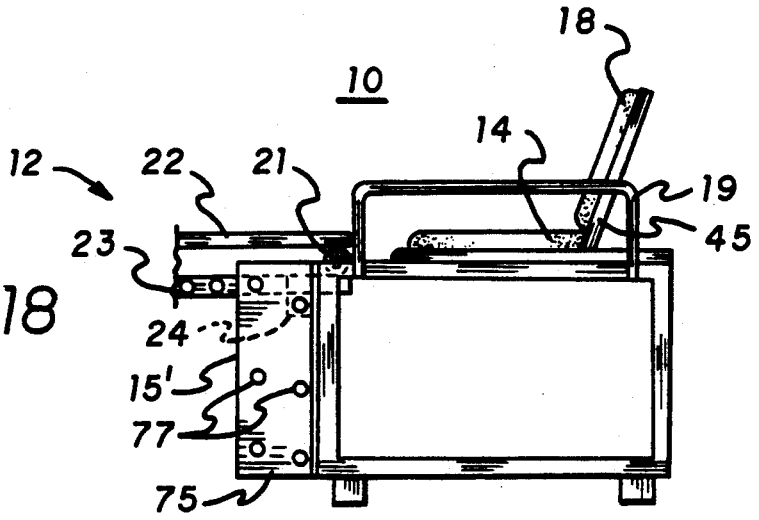
FIG. 18 is a side view of the third modification of the structural frame unit.
Figure 19:
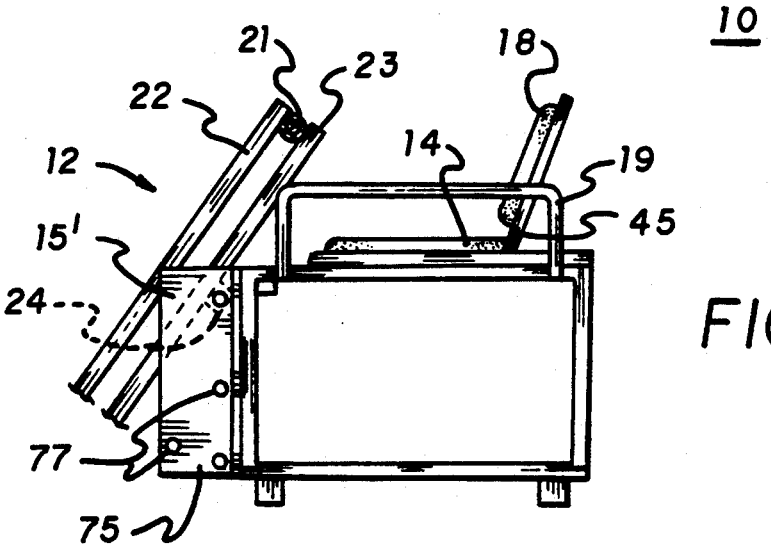
FIG. 19 is a side view of the third modification of the structural frame unit similar to FIG. 18 showing the rotational belt assembly unit in a partially collapsed position for storage purposes.

FIGS. 17, 18 and 19 show a third modification of structural frame unit 11. In this modification, vertical support member 16 and horizontal support member 17 are eliminated, and vertical support member 15 is modified as shown by angled member 15' having a substantially elongated leg 75, which provides support for rod 41 and a second rod 76 which are inserted into openings 77 in leg 75, whereby rotational belt assembly unit 12 is supported solely by angled member 15'. In FIG. 19, rotational belt assembly unit 12 is shown in a collapsed position for storage. It should be noted that rotational belt assembly 12 although not shown includes all of the structural elements shown in FIGS. 1A–2C and 4A–6C, including element 26, that hand rail support members 19 are collapsible as shown in FIGS. 14 and 16, that elements 54 and 78 may be substituted for element 26, and that a basket 73 may be stored beneath seat support member 14 as shown in FIGS. 16, 21 and 22, along with rotational belt assembly 12.

Figure 20:
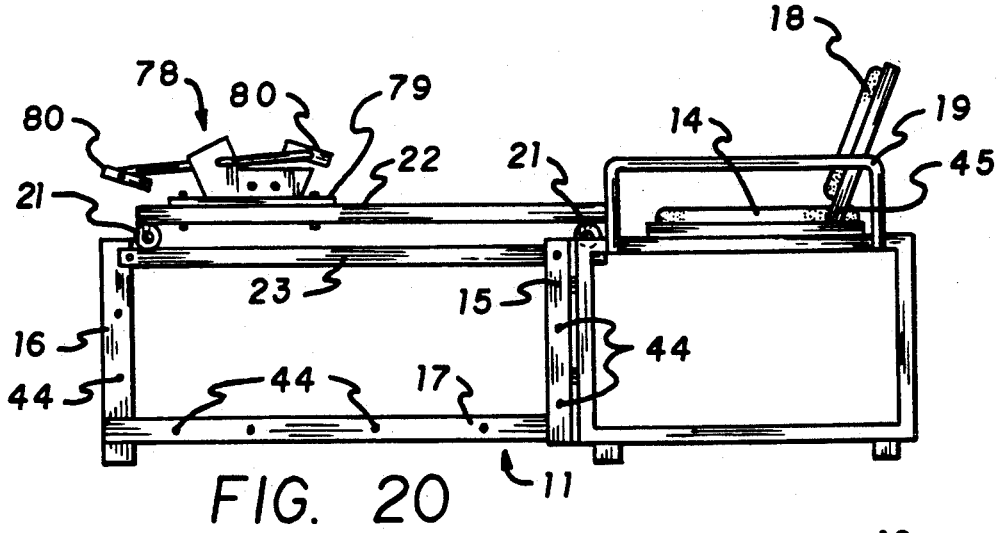
FIG. 20 is a side view of the rotational belt exercise apparatus with a conventional bicycle exercise device suitably mounted on the rotational belt assembly unit.
Figure 21:
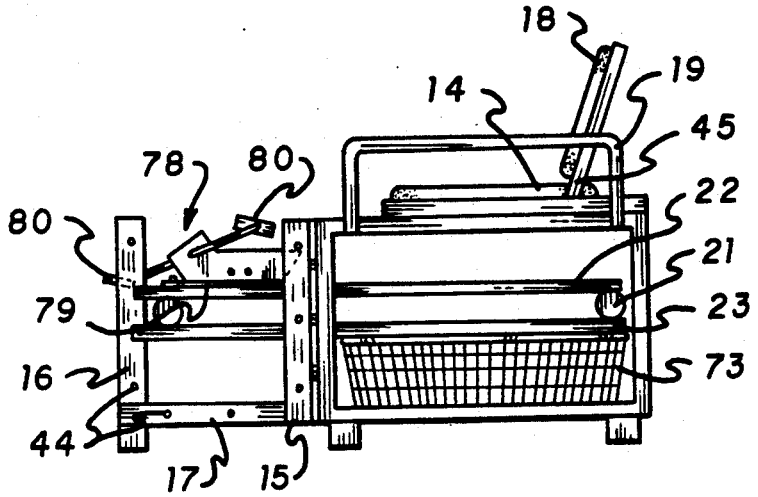
FIG. 21 is a side view of the rotational belt exercise apparatus of FIG. 20 in the collapsed position for storage, with the rotational belt assembly unit stored above the basket of FIG. 16.
Figure 22:
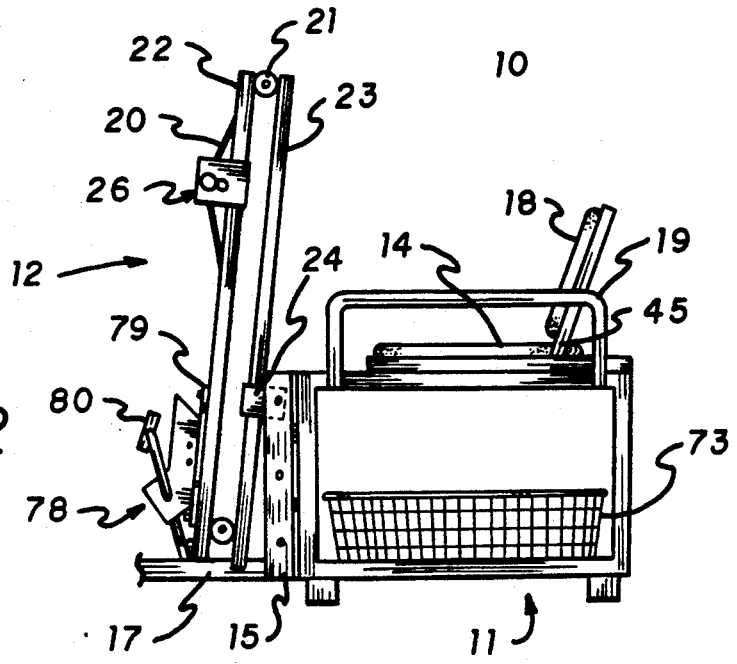
FIG. 22 is a side view showing the rotational belt assembly in another storage position together with the basket of FIG. 16.

Shown in FIGS. 20, 21 and 22 is a conventional bicycling attachment 78 which does not rely upon the belt resistance of the rotational belt assembly unit 12 of this invention. Bicycling attachment 78 incorporates a self-contained resistance unit (not shown, but which is conventional) and is mounted on a support plate 79 which in turn is bolted to upper guide rail 22. Reference numerals 80 denote the foot pedals of the conventional bicycling attachment 78. In like fashion, other conventional exercise attachments may be added to rotational belt exercise apparatus 10.

FIG. 21 shows rotational belt assembly unit 12 stored underneath seat support member 14 above basket 73, together with conventional bicycling attachment 78. FIG. 22 shows another storage position for rotational belt assembly unit 12, together with conventional bicycling attachment 78.

While it will be apparent that the preferred embodiment of the invention herein disclosed is well-calculated to fulfill the objects above stated, it will be appreciated that the invention is susceptible to modification, variation and change without departing from the proper scope of fair meaning of the subjoined claims.

I claim:

1. A rotational belt exercise apparatus comprising:

a structural frame means having an adjustable seat means mounted thereon;

a rotational belt assembly means having a rotatable closed loop belt means adjustably mounted on said frame means between a substantially horizontal position and a substantially vertical position;

said structural frame means comprising:

a vertical and horizontal support means for supporting at least one end of said rotational belt assembly means; and a second vertical support means for supporting a second end of said rotational belt assembly means; and user engagement means directly connected to said rotational belt means to operate said rotational belt assembly means; whereby a user may participate in upper and lower body exercises while in a seated position.

2. A rotational belt exercise apparatus as in claim 1, said structural frame means further comprising:

a horizontal seat means fixedly mounted on said frame means, and a seat back support means adjustably and reversibly mounted on said frame means, said horizontal seat means and said seat back support means comprising said adjustable seat means;

said vertical and horizontal support means being constructed as an integral L-shaped vertical and horizontal support means;

said structural frame means being collapsible for compact storage by disconnecting said integral L-shaped vertical and horizontal support means from the remainder of said frame means; whereby said horizontal support means may be moved in a forward direction and reconnected to said structural frame means to underlie said horizontal seat support means.

3. A rotational belt exercise apparatus as in claim 2, said horizontal support means being connected to the remainder of said frame means by sleeve means, said horizontal support means of said vertical and horizontal support means being slidable in said sleeve means and held in adjusted position by bolt means.

4. A rotational belt exercise apparatus as in claim 2, further comprising:

basket means disposed beneath said horizontal seat means for storage of accessories;

said basket means being configured to accommodate said horizontal support means of said vertical and horizontal support means when moved in a forward direction to underlie said horizontal seat support means.

5. A rotational belt exercise apparatus as in claim 1, wherein:

said vertical and horizontal support means comprise a pair of L-shaped vertical support member means, each having a short leg and a long leg, said long leg being sufficient to support said rotational belt assembly in both the horizontal and the substantially vertical position.

6. A rotational belt exercise apparatus as in claim 2, said rotational belt assembly means being stored beneath said horizontal seat support means when said structural frame means is collapsed for compact storage.

7. A rotational belt exercise apparatus as in claim 4, said rotational belt assembly means being stored beneath said horizontal seat support means above said basket means when said structural frame means is collapsed for compact storage.

8. A rotational belt exercise apparatus as in claim 5, said structural frame means further comprising:

a horizontal seat means fixedly mounted on said frame means, hand rail support means for providing support to the user, and a seat back support means adjustably and reversibly mounted on said frame means, said horizontal seat means and said seat back support means comprising said adjustable seat means;

said rotational belt exercise apparatus being collapsible by lowering said hand rail support means, and by disconnecting said rotational belt assembly means from said structural frame means to enable storage of said rotational belt assembly means beneath said horizontal seat means.

9. A rotational belt exercise apparatus as in claim 1, said user engagement means including force-transmitting means cooperating with said rotatable closed loop belt means and operable through manual operation to move said closed loop belt means in at least one direction, said force transmitting means comprising:

a rotatable drive roller means for driving said belt means;

rotatable shaft means mounting said drive roller means thereon, said shaft means being bent to provide pedal support means; and pedal means mounted on said pedal support means; whereby a user may participate in bicycle-type exercises.

10. A rotational belt exercise apparatus as in claim 2, said horizontal support means of said vertical and horizontal support means being connected to the remainder of said frame means by block means having openings therein to accommodate said horizontal support means of said vertical and horizontal support means, and set screw means mounted on said block means and engageable with said horizontal support means of said vertical and horizontal support means.

11. A rotational belt exercise apparatus comprising:

a structural frame means having an adjustable seat means mounted thereon;

a rotational belt assembly means having a rotatable closed loop belt means adjustably mounted on said frame means between a substantially horizontal position and a substantially vertical position and including a rotatable closed loop belt means;

belt adjustment means for adjusting resistance to belt motion and operatively cooperating with said closed loop belt means; and user engagement means directly connected to said rotational belt means to operate said rotational belt assembly means, said user engagement means including force-transmitting means cooperating with said rotatable closed loop belt means and operable through manual operation to move said closed loop belt means in at least one direction; whereby a user may participate in body exercises while in a seated position.

12. A rotational belt exercise apparatus as in claim 11, said force-transmitting means comprising a gripping means, whereby said force-transmitting means moves said belt means in at least one direction when said force-transmitting means is operated by the user.

13. A rotational belt exercise apparatus as in claim 11, said force-transmitting means comprising:

a rotatable drive roller means for driving said belt means;

rotatable shaft means mounting said drive roller means thereon, said shaft means being bent to provide pedal support means; and pedal means mounted on said pedal support means; whereby a user may participate in bicycle-type exercises.

14. A rotational belt exercise apparatus as in claim 12, said gripping means comprising:

an eccentrically mounted, selectively positionable cylinder means rotatably supported by an upper axle means, said cylinder means being engageable with an outer surface of said belt means mounted on said force-transmitting means;

a first lower support rod means engageable with an inner surface of said belt means and cooperable with said cylinder means to grip and push said belt means in a first direction of movement of said force-transmitting means and to release said belt means in a second opposite direction of movement of said force-transmitting means, the first and second directions of movement being dependent upon the side of said first lower support rod means said cylinder means is located when engageable with said outer surface of said belt means;

a second lower support rod means engageable with said inner surface of said belt means spaced from said first lower support rod means;

said upper axle means being positionable in two different locations enabling said cylinder means to cooperate simultaneously with said first and second support rod means to thereby drive said belt means in both said first direction and said second direction; whereby said force-transmitting means selectively may drive said belt means in said first direction, said second direction, and both directions, as desired.

15. A rotational belt exercise apparatus as in claim 11, wherein said rotational belt assembly means further comprises a pair of roller means for mounting said rotatable closed loop belt means thereon for rotation thereabout, said belt adjustment means including means to adjust the location of one of said two roller means.

16. A rotational belt exercise apparatus as in claim 11, wherein said rotational belt assembly means further comprises a pair of roller means for mounting said rotatable closed loop belt means thereon for rotation thereabout, said belt adjustment means including an adjustable pressure roller means adjustably pressing said belt means against one of said pair of roller means.

17. A rotational belt exercise apparatus comprising:

a structural frame means having an adjustable seat means mounted thereon;

a rotational belt assembly means adjustably mounted on said frame means between a substantially horizontal position and a substantially vertical position, said rotational belt assembly means including a rotatable closed loop belt means; and user engagement means directly connected to said rotational belt means to operate said rotational belt assembly means;

said user engagement means comprising:

force-transmitting means cooperating with said rotatable closed loop belt means and operable through manual operation to move said closed loop belt means in at least one direction; and a cylindrical means, a footrest means and a handle means, one of which is selected and operatively connected to said force-transmitting means; whereby a user may manually operate said rotational belt assembly means through a selected one of said cylindrical means, said footrest means and said handle means of said user engagement means.

* * * * *